US008764418B2

(12) United States Patent
Yen et al.

(10) Patent No.: US 8,764,418 B2
(45) Date of Patent: Jul. 1, 2014

(54) CENTRIFUGAL FAN

(75) Inventors: Kevin Yen, Nagano (JP); Hiromitsu Kuribayashi, Nagano (JP)

(73) Assignee: Sanyo Denki Co., Ltd., Tokyo (JP)

( * ) Notice: Subject to any disclaimer, the term of this patent is extended or adjusted under 35 U.S.C. 154(b) by 463 days.

(21) Appl. No.: 12/707,248

(22) Filed: Feb. 17, 2010

(65) Prior Publication Data

US 2010/0209270 A1 Aug. 19, 2010

(30) Foreign Application Priority Data

Feb. 17, 2009 (JP) ..... 2009-034196
Jun. 12, 2009 (JP) ..... 2009-141587

(51) Int. Cl.
*F04D 29/30* (2006.01)

(52) U.S. Cl.
USPC ..... 417/423.6; 417/423.1; 417/436; 417/423.14; 416/185; 416/186 R

(58) Field of Classification Search
USPC ..... 417/423.1, 436, 423.6; 416/185, 186 R, 416/188, 198 R
See application file for complete search history.

(56) References Cited

U.S. PATENT DOCUMENTS 4,521,154 A 6/1985 Corbett
4,930,984 A * 6/1990 Kesel et al. ..... 416/203
5,803,721 A * 9/1998 Lee ..... 417/423.14
5,814,908 A * 9/1998 Muszynski ..... 310/62
6,042,335 A 3/2000 Amr
6,171,078 B1 * 1/2001 Schob ..... 417/423.1
6,224,335 B1 * 5/2001 Parisi et al. ..... 415/206
6,345,956 B1 2/2002 Lin
6,382,936 B1 * 5/2002 Schuler et al. ..... 417/423.1
6,474,960 B1 * 11/2002 Hansmann ..... 417/363
6,755,615 B2 * 6/2004 Chapman ..... 415/206
6,877,954 B2 * 4/2005 Lin et al. ..... 416/175
7,044,720 B1 * 5/2006 Yamamoto et al. ..... 417/423.1

(Continued)

FOREIGN PATENT DOCUMENTS

CN 101275582 10/2008
EP 0955468 11/1999

(Continued)

OTHER PUBLICATIONS

Machine translation of JP 2006077631 A.*

(Continued)

*Primary Examiner* — Christopher Bobish
(74) *Attorney, Agent, or Firm* — Rankin, Hill & Clark LLP

(57) ABSTRACT

An impeller comprises an impeller body, a plurality of stems, a blade mounting member, and a plurality of blades. The stems radially extend with one end of each stem fixed to a portion of a circumferential wall of the impeller body in the vicinity of a suction port, and are arranged at intervals in a circumferential direction of the circumferential wall. The stems assist the impeller to suck air Jn an axial direction through a suction port during rotation of the impeller. The blade mounting member is disposed concentrically with the circumferential wall of the impeller body. The other end of each stem is fixed to the blade mounting member. The blades are arranged at intervals in the circumferential direction and extend along an axial line toward a second wall portion, with one end of each blade fixed to the blade mounting member.

1 Claim, 7 Drawing Sheets

(56) References Cited

U.S. PATENT DOCUMENTS

| | | | | |
|---|---|---|---|---|
| RE39,117 | E * | 6/2006 | Matsumoto | 417/423.15 |
| 7,125,226 | B2 * | 10/2006 | Horng et al. | 416/203 |
| 7,173,353 | B2 * | 2/2007 | Lopatinsky et al. | 310/58 |
| RE39,787 | E * | 8/2007 | Matsumoto | 417/423.15 |
| 7,540,722 | B2 * | 6/2009 | Nishikawa et al. | 417/312 |
| 7,607,886 | B2 * | 10/2009 | Hsu et al. | 415/206 |
| 7,905,708 | B2 * | 3/2011 | Fan et al. | 416/178 |
| 7,976,293 | B2 * | 7/2011 | Kusano | 417/423.7 |
| 2002/0090308 | A1 | 7/2002 | Cheng | |
| 2002/0106277 | A1 | 8/2002 | Chapman | |
| 2003/0049142 | A1 * | 3/2003 | Chia-Kuan et al. | 417/423.1 |
| 2005/0121996 | A1 * | 6/2005 | Lopatinsky et al. | 310/268 |
| 2005/0260070 | A1 | 11/2005 | Hsu et al. | |
| 2006/0207748 | A1 * | 9/2006 | Hashimoto et al. | 165/80.3 |
| 2009/0290307 | A1 * | 11/2009 | Hwang et al. | 361/695 |
| 2010/0303652 | A1 * | 12/2010 | Peng et al. | 417/423.1 |

FOREIGN PATENT DOCUMENTS

| | | | |
|---|---|---|---|
| JP | 61-145899 | U | 9/1986 |
| JP | 05-332293 | | 12/1993 |
| JP | 06-129396 | | 5/1994 |
| JP | 07-111756 | | 4/1995 |
| JP | 07-279892 | | 10/1995 |
| JP | 2001-140790 | | 5/2001 |
| JP | 3105067 | U | 10/2004 |
| JP | 2006-077631 | | 3/2006 |
| JP | 2006077631 | A * | 3/2006 |

OTHER PUBLICATIONS

Chinese Office action dated Apr. 3, 2013, English translation (excerpts) included.

Japanese Office Action and English Translation of JP 2009-141587, mailed Mar. 5, 2013, 6 pages.

Japanese Office Action and English Translation of JP 2009-14162, mailed Mar. 5, 2013, 7 pages.

Philippine Office Action dated Sep. 27, 2013, 3 pages.

* cited by examiner

CENTRIFUGAL FAN

TECHNICAL FIELD

The present invention relates to a centrifugal fan.

BACKGROUND ART

Japanese Patent Application Publication No. 2006-77631 discloses a centrifugal fan referred to as a sirocco fan. The fan comprises an impeller and a casing. The impeller comprises a plurality of blades. The impeller is fixed to the rotary shaft of an electric motor to rotate therewith. The casing includes a suction port and a discharge port. The suction port opens in an axial direction of the rotary shaft, and the discharge port opens in a direction tangent to a direction of rotation of the impeller. The casing includes a first wall portion in which the suction port is formed, a second wall portion facing the first wall portion, and a third wall portion including the discharge port. The third wall portion couples the first and second wall portions. The impeller includes an impeller body and a blade support body. The impeller body has a cylindrical circumferential wall which rotates about the rotary shaft. The blade support body is fixed to the impeller body and supports the blades. The blade support body is shaped like a circular plate having an opening portion in its center. The periphery of an opening portion of the blade support body is fixed to the circumferential wall of the impeller body. The blades are fixed to a radially outside end portion of the blade support body. The blades extend from the radially outside end portion of the blade support body toward the first wall portion of the casing. Ends of the blades, located on the side of the first wall portion, are fixed to an annular blade mounting member which is disposed concentrically with the circumferential wall of the impeller body.

SUMMARY OF INVENTION

Reduction of noise and power consumption is demanded for fans mentioned above, without reducing static pressure with respect to airflow rate (or without degrading an airflow-static pressure characteristic).

An object of the present invention is therefore to provide a centrifugal fan in which noise and power consumption may be reduced without reducing static pressure with respect to airflow rate (or without degrading an airflow-static pressure characteristic).

A centrifugal fan, improvements of which are aimed at by the present invention, comprises: an electric motor including a rotary shaft; an impeller including a plurality of blades and fixed to the rotary shaft of the electric motor to rotate therewith; and a casing including a suction port which opens in an axial direction of the rotary shaft. The impeller of the present invention further includes; an impeller body; a plurality of stems, an annular blade mounting member; and a plurality of blades. The impeller body rotates about the rotary shaft. The stems are arranged at intervals in a direction of rotation of the rotary shaft, with one end of each stem fixed to a portion of the impeller body in the vicinity of the suction port. The annular blade mounting member is arranged radially outside the impeller body, being concentric with the impeller body, with the other end of each stem fixed thereto. The blades are arranged at intervals in the direction of rotation of the rotary shaft and extend along an axial line of the rotary shaft, with one end of each blade fixed to the blade mounting member. In the configuration of the present invention, the blades are arranged with the one end of each blade fixed to the blade mounting member located on the side of the suction port. Accordingly, no member for mounting the blades is present at a location facing the suction port of the casing in the axial direction. For that reason, apart of air suctioned into the casing through the suction port is directed in a radial direction of the impeller body and is then discharged after having hit against an inner wall surface of the casing which faces the suction port.

More specifically, a centrifugal fan of the present invention comprises: an electric motor including a rotary shaft; an impeller including a plurality of blades and fixed to the rotary shaft of the electric motor to rotate therewith; and a casing including a suction port and a discharge port. The suction port opens in an axial direction of the rotary shaft, while the discharge port opens in a direction tangent to a direction of rotation of the impeller. The impeller of the present invention further includes an impeller body, a plurality of stems, an annular blade mounting member, and a plurality of blades. The impeller body includes a cylindrical circumferential wall which extends along an axial line of the rotary shaft and rotates about the rotary shaft. The stems are arranged at intervals in the direction of rotation of the rotary shaft, with one end of each stem fixed to a portion of the circumferential wall in the vicinity of the suction port. The annular blade mounting member is arranged radially outside the circumferential wall, being concentric with the circumferential wall, with the other end of each stem fixed thereto. The blades are arranged at intervals in the direction of rotation of the rotary shaft and extend along the axial line, with one end of each blade fixed to the blade mounting member. The blades suck air from the suction port in the axial direction and then direct the sucked air in a radial direction of the circumferential wall.

When the blades are mounted on the annular blade mounting member supported by the stems which are located in the vicinity of or close to the suction port as in the present invention, a flow of the air from the suction port to the discharge port is smoothed. Further, occurrence of a vortex flow on the blade may be thereby prevented. For that reason, noise may be reduced. According to the present invention, resistance of the air during rotation of the impeller in a normal rotation direction may be reduced. Thus, power consumption may be reduced. When the stems are in particular disposed in the vicinity of the suction port to assist the impeller to suck the air in the axial direction, great reduction of static pressure with respect to airflow rate (degradation of an airflow-static characteristic) may be prevented.

The stems may arbitrarily be shaped, and preferably be shaped to assist the impeller to suck the air in the axial direction through the suction port during rotation of the impeller in the normal rotation direction. With this arrangement, the air flow from the suction port to the discharge port is helped to smoothly flow.

Various shapes may be adopted for the stem if the shapes are suited to sucking (feeding in) the air in the axial direction. The stem, for example, may be formed to have a curved section as cut in a direction orthogonal to a longitudinal direction of the stem. The curved section is curved to be convex in a direction opposite to the normal rotation direction of the impeller. With this arrangement, the amount of the air which is flown in the axial direction may be increased, as with blades of a common axial-flow fan.

The stem includes a first end edge portion located on the side of the suction port and a second end edge portion located opposite to the suction port. The first end edge portion is shifted more than the second end edge portion in the normal rotation direction of the impeller. With this arrangement, the impeller may actively suck the air through the suction port, using the stems.

Alternatively, the stem may be formed to have a rectangular section being long in the axial direction as cut in the direction orthogonal to the longitudinal direction of the stem. With this arrangement, the stem of a simple shape may be readily formed.

The casing may be constituted from: a first wall portion with the suction port formed therein; a second wall portion facing the first wall portion with the impeller interposed therebetween; and a third wall portion which couples the first wall portion and the second wall portion. Then, the other end of each stem may be terminated radially outside an opening edge portion of the suction port. The annular blade mounting member may be located radially outside the opening edge portion and may include a first side surface facing the first wall portion and a second side surface facing the first side surface in the axial direction. In this configuration, the first side surface of the annular blade mounting member may be curved such that a distance between the first side surface and the first wall portion increases radially outwardly and the curved surface is convex toward the second wall portion. This arrangement smoothes the air flow. A sound pressure level may be thereby reduced.

The second side surface of the annular blade mounting member may have a curved surface which extends in parallel with the first side surface. Then, the one end of each blade may be fixed to the second side surface. With this arrangement, the air may be guided smoothly between the blades along the second side surface of the annular blade mounting member.

Further, at least apart of the blades each may include: a first side portion; a second side portion; a third side portion; and a fourth side portion. The first side portion extends along the second side surface of the annular blade mounting member. The second side portion faces the third wall portion of the casing and extends in the axial direction from one end thereof fixed to the blade mounting member. The third side portion is located radially more inwardly than the second side portion. The fourth side portion faces the second wall portion of the casing. In this case, preferably, the third side portion includes a first half portion continuous with the first side portion, and a second half portion continuous with the first half portion and the fourth side portion. Then, preferably, the first half portion is so inclined that a distance between the first half portion and the second side portion increases toward the second half portion, and the second half portion extends in parallel with the second side portion. With this arrangement, a space may be ensured between the inclined first half portion and the suction port. Thus, if a direction of the air sucked through the suction port in the axial direction is changed in the radial direction, the direction may be changed smoothly.

BRIEF DESCRIPTION OF DRAWINGS

These and other objects and many of the attendant advantages of the present invention will be readily appreciated as the same becomes better understood by reference to the following detailed description when considered in connection with the accompanying drawings.

DETAILED DESCRIPTION OF EMBODIMENTS

Figure 1:
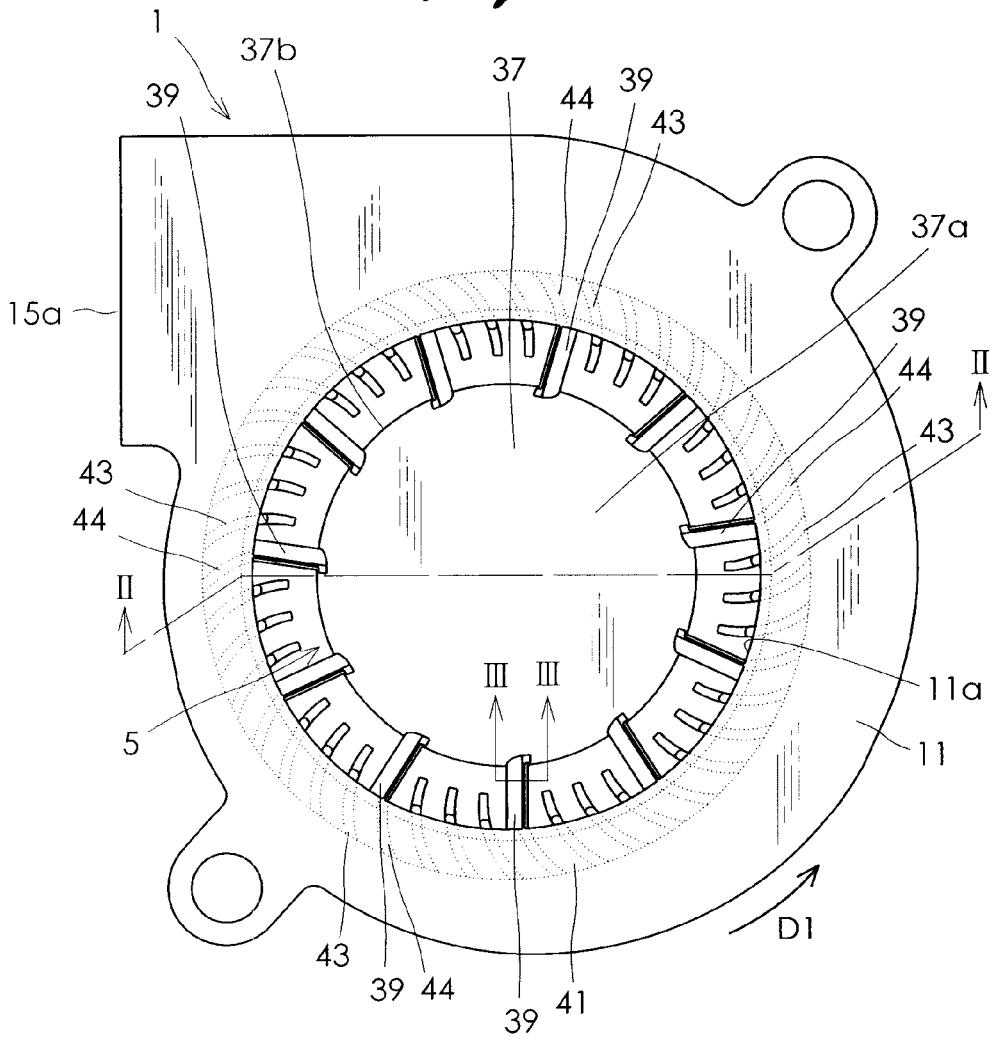
FIG. 1 is a plan view of a centrifugal fan according to an embodiment of the present invention.
Figure 2:
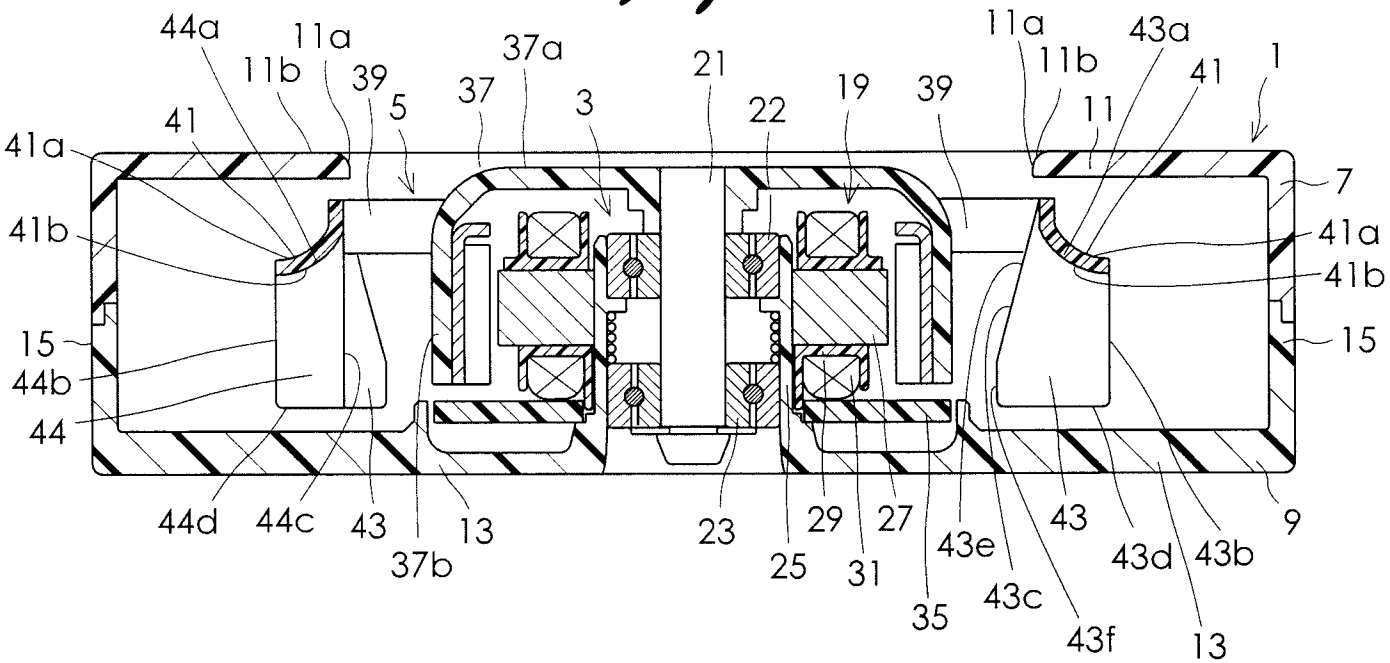
FIG. 2 is a sectional view taken along line II-II of FIG. 1.

Embodiments of the present invention will be described below in detail with reference to drawings. FIG. 1 is a plan view of a centrifugal fan in an embodiment of the present invention. FIG. 2 is a sectional view taken along line II-II of FIG. 1. The centrifugal fan (sirocco fan) in this embodiment comprises a casing 1, an electric motor 3, and an impeller 5 disposed in the casing 1. The casing 1 is formed by combining a first casing half portion 7 and a second casing half portion 9, as shown in FIG. 2. The casing 1 includes a first wall portion 11, a second wall portion 13, and a third wall portion 15, with the first casing half portion 7 being combined with the second casing half portion 9. The second wall portion 13 faces the first wall portion 11 with the impeller 5 interposed between the first wall portion 11 and the second wall portion 13. The third wall portion 15 couples the first wall portion 11 and the second wall portion 13. A circular suction port 11*a* is formed in the center of the first wall portion 11. The circular suction port 11*a* sucks air from an outside. A discharge port 15*a* is formed in the third wall portion 15. The discharge port 15*a* opens in a direction tangent to a direction of rotation of the impeller 5 and discharges the air to the outside. The first to third wall portions 11 to 15 are connected to define an area, a part of which works as an air passage which guides the air discharged from the impeller 5 to the discharge port 15*a*.

The electric motor 3 disposed in the casing 1 includes a stator 19 and a rotary shaft 21. The stator 19 is fitted on a bearing holder 25. Two ball bearings 22 and 23 which rotatably support the rotary shaft 21 are fitted and held in the bearing holder 25. The stator 19 comprises a stator core 27, an insulator 29 made of an insulating resin, and stator windings 31. The stator core 27 is disposed outside the bearing holder 25. The insulator 29 is fit in the stator core 27. The stator windings 31 are wound on a plurality of salient-pole portions of the stator core 27 through the insulator 29. The stator windings 31 are each electrically connected to a circuit pattern on a circuit board 35, not shown, through a connecting conductor. A drive circuit is mounted on the circuit board 35 for feeding an exciting current to the stator windings 31.

The impeller 5 which is rotated by the electric motor 3 is formed of a synthetic resin, and integrally includes an impeller body 37, 11 stems 39, a blade mounting member (shroud) 41, and 44 blades (33 first blades 43 and 11 second blade 44). The impeller body 37 comprises a bottom wall 37*a* with a central portion thereof fixed to the rotary shaft and a cylindrical circumferential wall 37*b*. The cylindrical circumferential wall 37*b* extends along an axial line of the rotary shaft 21 and rotates about the rotary shaft 21. The impeller 5 in this embodiment rotates in a counterclockwise direction (indicated by an arrow D1), as viewed in the paper of FIG. 1, as a normal rotation direction.

The 11 stems 39 radially extend with one end of each stem fixed to a portion of the circumferential wall 37*b* of the impeller body 37 in the vicinity of or close to the suction port 11*a*. Then, the 11 stems 39 are arranged at intervals in a circumferential direction of the circumferential wall 37*b* or the direction of rotation of the impeller 5. The term "radially extend" as used herein refers to extending inclined at a predetermined angle to an exactly radial direction of the circumferential wall 37*b* as well as extending in the exactly radial direction. The other end of each of the stems 39 is terminated at positions located radially outside an opening edge portion 11*b* of the suction port 11*a*.

Figure 3:
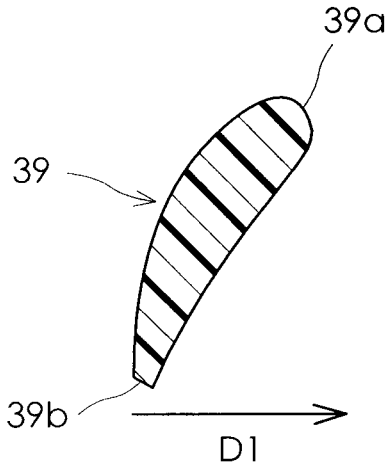
FIG. 3 is a sectional view taken along line III-III of FIG. 1.

The stem 39 has a curved section as cut in a direction orthogonal of a longitudinal direction of the stem 39, as shown in the sectional view of FIG. 3. The curved section of the stem 39 curves to be convex in a direction opposite to the normal rotation direction of the impeller 5 (indicated by the arrow D1). The stem 39 comprises a first end edge portion 39*a* located on the side of the suction port 11*a* and a second end edge portion 39*b* on the side of the impeller 5. The first end edge portion 39*a* is shifted more than the second end edge portion 39*b* in the normal rotation direction of the impeller 5 (indicated by the arrow D1). Such a shape of the stem 39 assists the impeller 5 to suck the air in an axial direction of the motor through the suction port 11*a* while the impeller is rotating.

The blade mounting member 41 has an annular shape, and is located radially outside the opening edge portion 11*b* of the suction port 11*a*. Then, the blade mounting member 41 is disposed radially outside the circumferential wall 37*b*, being concentric with the circumferential wall 37*b*. The other end of each of the stems 39 is fixed to the blade mounting member 41. The blade mounting member 41 includes a first side surface 41*a* facing the first wall portion 11 of the casing 1 and a second side surface 41*b* facing the first side 41*a* in the axial direction. The first side surface 41*a* is curved such that a distance between the first side surface 41*a* and the first wall portion 11 increases radially outwardly and the curved surface is convex toward the second wall portion 13. The second side surface 41*b* is curved to extend in parallel with the first side surface 41*a*.

The 33 first blades 43 and the 11 second blades 44 are arranged at intervals in the circumferential direction with one end of each blade being fixed to the blade mounting member 41. The 33 first blades 43 and the 11 second blades 44 extend toward the second wall portion 13 along the axis line. Three of the first blades 43 are interposed between adjacent two of the stems 39. The first blade 43 shown on the right of the page of FIG. 2 comprises a first side portion 43*a*, a second side portion 43*b*, a third side portion 43*c*, and a fourth side portion 43*d*. The first side portion 43*a* extends along the second side surface 41*b* of the blade mounting member 41. The second side portion 43*b* faces the third wall portion 15 of the casing 1 and extends in the axial direction from one end of the second side portion 43*b* fixed to the blade mounting member 41. The third side portion 43*c* is located radially more inwardly than the second side portion 43*b*. The fourth side portion 43*d* faces the second wall portion 13 of the casing 1. The third side portion 43*c* comprises a first half portion 43*e* and a second half portion 43*f*. The first half portion 43*e* is continuous with the first side portion 43*a*. The second half portion 43*f* is continuous with both the first half portion 43*e* and the fourth side portion 43*d*. The first half portion 43*e* is so inclined that a distance between the first half portion 43*e* and the second side portion 43*b* increases toward the second half portion 43*f*. The second half portion 43*f* extends in parallel with the second side portion 43*b*.

The 11 second blades 44 are disposed radially outside the 11 stem 39, as shown on the left of the page of FIG. 2. The second blades 44 each comprise a first side portion 44*a*, a second side portion 44*b*, a third side portion 44*c*, and a fourth side portion 44*d*. The first side portion 44*a* extends along the second side surface 41*b* of the blade mounting member 41. The second side portion 44*b* faces the third wall portion 15 of the casing 1 and extends in the axial direction from one end of the blade fixed to the blade mounting member 41. The third side portion 44*c* is located radially more inwardly than the second side portion 44*b* and extends in parallel with the circumferential wall 37*b* of the impeller body 37. The fourth side portion 44*d* faces the second wall portion 13 of the casing 1. The blades 43 and 44 serve to suck the air from the suction portion 11*a* in the axial direction and then direct the sucked air in the radial direction.

Figure 4:
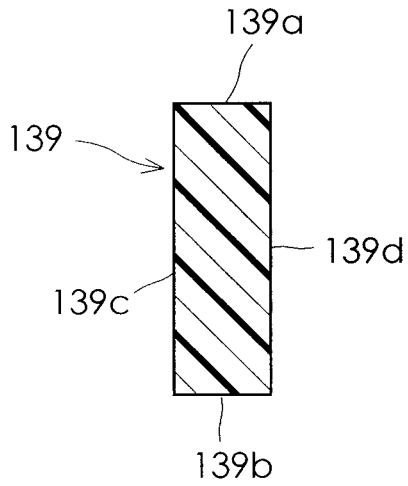
FIG. 4 is a sectional view of a centrifugal fan according to an embodiment of the present invention.
Figure 5:
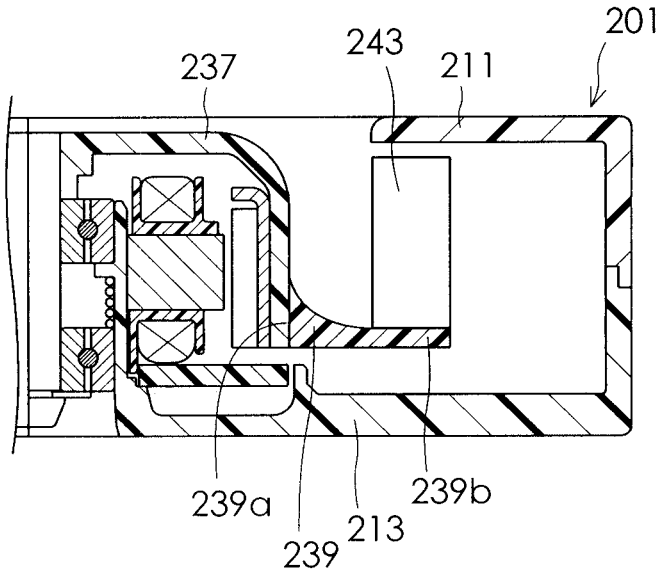
FIG. 5 is a partial sectional view of a centrifugal fan of a comparative example used for a test.

The stem 39 in this embodiment has a curved section as cut in the direction orthogonal of the longitudinal direction of the stem 39. Various shapes, however, may be adopted for the stem 39. A stem 139 having a rectangular section, as shown in FIG. 4 for example, may also be adopted. The rectangular section is obtained by cutting the stem 139 in a direction orthogonal to the longitudinal direction of the stem 139. The stem 139 comprises surfaces 139*a* and 139*b* facing each other and surfaces 139*c* and 139*d* facing each other. The surfaces 139*a* and 139*b* are short in width, while the surfaces 139*c* and 139*d* are long in width. The two surfaces 139*c* and 139*d* extend in the axial direction. For this reason, the stem has the rectangular section being long in the axial direction.

Next, the centrifugal fan in Embodiment 1 and a centrifugal fan in Embodiment 2 were rotated at a speed of 5100 $min^{-1}$, and a centrifugal fan in a comparative example was rotated at a speed of 5000 $min^{-1}$. Then, relationships between airflow rates and static pressures and relationships between the air flow rates and noise in the centrifugal fans in Embodiments 1 and 2 and the comparative example were examined. The centrifugal fan in Embodiment 1 is shown in FIGS. 1 to 3. The centrifugal fan in Embodiment 2 uses the stems each having the rectangular shape shown in FIG. 4. The centrifugal fan in Embodiment 2 has the same structure as the centrifugal fan in Embodiment 1 except this respect. The centrifugal fan in the comparative example is different from the centrifugal fan in each embodiment of the present invention in 44 blades and a support structure of the 44 blades. Except these respects, the centrifugal fan in the comparative example has the same structure as the centrifugal fan in each embodiment of the present invention. A blade support body 239 which supports 44 blades 243 of the centrifugal fan of the comparative example has a circular plate shape with an opening portion 239*a* in the center thereof. The periphery of the opening portion 239*a* of the blade support body 239 is fixed to a portion of an impeller body 237 on the side of a second wall portion 213. 33 blades 243 are fixed to a radially outward end portion 239*b* of the blade support body 239. Each blade is rectangular and extends from the radially outward end portion 239*b* of the blade support body 239 toward a first wall portion 211 of a casing 201.

Figure 6:
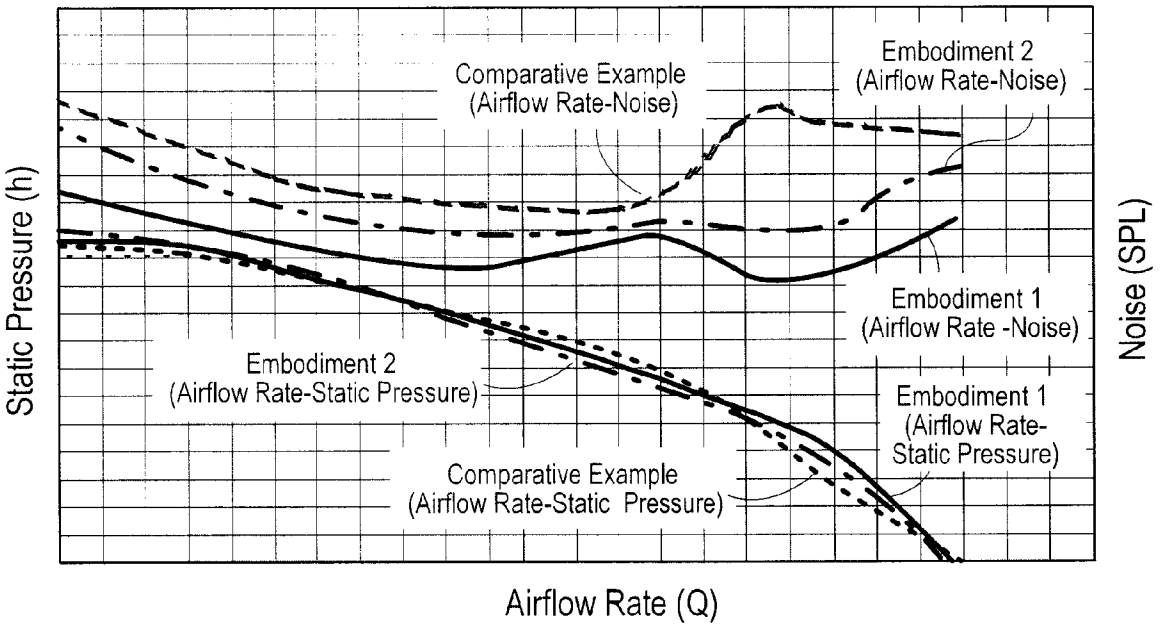
FIG. 6 is a graph showing relationships between airflow rates and static pressures and relationships between the airflow rates and noise in the centrifugal fans used for the test.

FIG. 6 is a graph showing measurement results. It can be seen from FIG. 6 that the centrifugal fans in Embodiments 1 and 2 and the comparative example have substantially the same static pressure values with respect to the air flow rates, or have substantially the same airflow-static pressure characteristic. Then, it can be seen that the centrifugal fans in Embodiments 1 and 2 may reduce noise more than the centrifugal fan in the comparative example. It can be seen that the noise of the centrifugal fan in Embodiment 1 which uses the stems 39 each having the section of the curved shape is reduced by 4 dB (A) at the maximum airflow rate. A flow of the air from the suction port 11*a* to the discharge port 15*a* may be smoothed due to the structures of the 11 stems 39, blade mounting member 41, and 44 blades 43 and 44. Then, occurrence of a vortex flow may be prevented, thereby leading to reduced noise.

Figure 7:
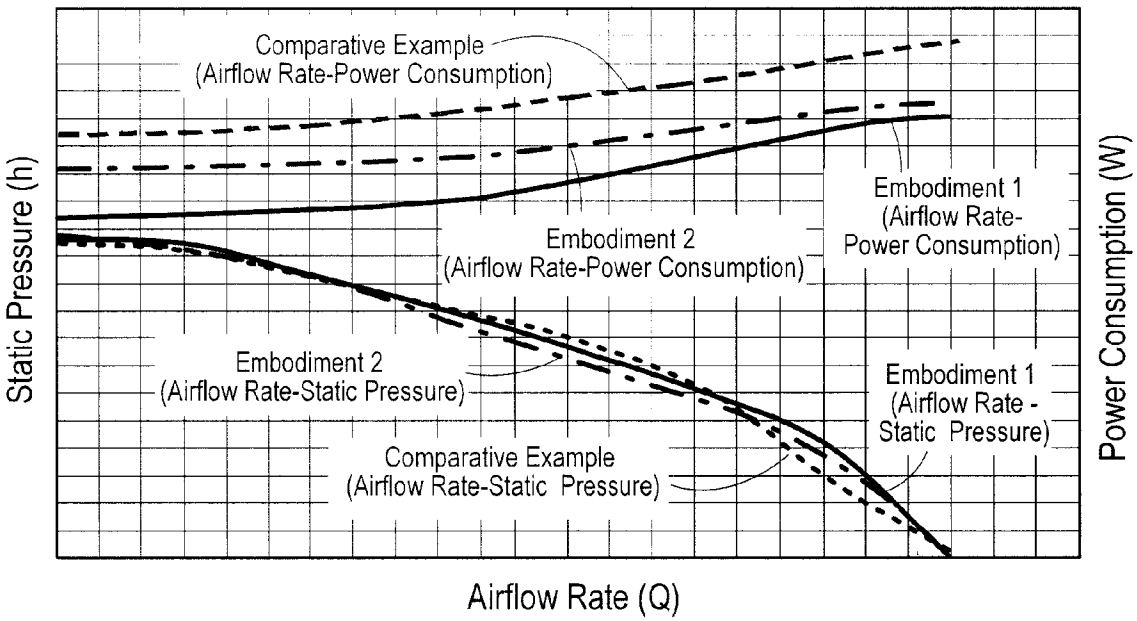
FIG. 7 is a graph showing the relationships between the airflow rates and the static pressures and relationships between the airflow rates and power consumption in the centrifugal fans used for the test.

Next, the relationships between the airflow rates and the static pressures and relationships between the air flow rates and power consumption in the centrifugal fans in Embodiments 1 and 2 and the comparative example were examined. FIG. 7 is a graph showing measurement results. It can be seen from FIG. 7 that the centrifugal fans in Embodiments 1 and 2 and the comparative example have substantially the same static pressure values with respect to the air flow rates, or have substantially the same airflow-static pressure characteristic. Then, it can be seen that the centrifugal fans in Embodiments 1 and 2 consume less power than the centrifugal fan in the comparative example. In particular, it can be seen that the power of the centrifugal fan of Embodiment 1 may be reduced by 19% at the maximum airflow rate. The flow of the air from the suction port 11*a* to the discharge port 15*a* may be smoothed due to the structures of the 11 stems 39 and the 44 blades 43 and 44. Then, air resistance against the 44 blades 43 and 44 may be reduced, thereby leading to reduce noise.

INDUSTRIAL APPLICABILITY

According to the present invention, the blades are provided at the annular blade mounting member fixed to the stems disposed in the vicinity of the suction port. Thus, the airflow from the suction port to the discharge port may be smoothed. In addition, occurrence of the vortex flow on the blade may be prevented. Noise may thus be reduced. Further, if the stems are configured to assist the impeller to suck air in the axial direction, noise and power consumption may be reduced without reducing static pressure with respect to airflow rate (without degrading the airflow-static pressure characteristic).

While the preferred embodiments of the invention have been described with a certain degree of particularity with reference to the drawings, obvious modifications and variations are possible in light of the above teachings. It is therefore to be understood that within the scope of the appended claims, the invention may be practiced other than as specifically described.

What is claimed is:

1. A centrifugal fan comprising:

an electric motor including a rotary shaft;

an impeller fixed to the rotary shaft of the electric motor to rotate; and a casing including a suction port opening in an axial direction of the rotary shaft, the casing being constituted from a first wall portion with the suction port formed therein, a second wall portion facing the first wall portion with the impeller interposed therebetween, and a third wall portion coupling the first wall portion and the second wall portion, wherein:

the impeller includes:

an impeller body that rotates about the rotary shaft, said impeller body including a cylindrical circumferential wall that extends along the axial line of the rotary shaft and a bottom wall that is located on a side of the suction port;

a plurality of stems located in the vicinity of the suction port and arranged at intervals in a direction of rotation of the rotary shaft, with one end of each stem fixed to a portion of the impeller body in the vicinity of the suction port;

an annular blade mounting member arranged in a radial direction outside the impeller body and concentrically with the impeller body, with the other end of each stem fixed thereto; and a plurality of blades arranged at intervals in the direction of rotation of the rotary shaft, extending along an axial line of the rotary shaft, and operable to suck air through the suction port in the axial direction and then direct the sucked air in the radial direction, with one end of each blade fixed to the blade mounting member;

the annular blade mounting member is located between the first wall portion and the second wall portion and radially outside the bottom wall;

the one end of each stem is fixed to a circumferential wall portion of the circumferential wall in the vicinity of the suction port;

each of the stems is shaped to assist the impeller to suck air in the axial direction through the suction port during rotation of the impeller in a normal rotation direction;

each of the stems has a curved section, as cut in a direction orthogonal to a longitudinal direction of the stem, which is curved to be convex in a direction opposite to the normal rotation direction of the impeller;

each of the stems includes a first end edge portion located on a side of the suction port and a second end edge portion located on a side opposite to the suction port;

the first end edge portion is shifted more than the second end edge portion in the normal rotation direction of the impeller;

the other end of each stem is terminated in the radial direction outside an opening edge portion of the suction port;

the annular blade mounting member is located in the radial direction outside the opening edge portion of the suction port;

the annular blade mounting member is located in the radial direction outside the opening edge portion and includes a first side surface facing the first wall portion and a second side surface facing the first side surface in the axial direction;

the first side surface of the annular blade mounting member is curved such that a distance between the first side surface and the first wall portion increases outwardly in the radial direction, and the curved surface is convex toward the second wall portion;

the second side surface is curved to extend in parallel with the first side surface;

the one end of each blade is fixed to the second side surface; and the blades include a plurality of first blades and a plurality of second blades;

each of the first blades including:

a first side portion extending along the second side surface of the annular blade mounting member;

a second side portion facing the third wall portion of the casing and extending from the one end toward the second wall portion;

a third side portion located radially more inwardly than the second side portion and extending toward the second wall portion; and, a fourth side portion facing the second wall portion of the casing;

the third side portion includes a first half portion continuous with the first side portion, and a second half portion continuous with the first half portion and the fourth side portion, the first half portion being inclined such that a distance between the first half portion and the second side portion increases toward the second half portion, and the second half portion extending in parallel with the second side portion;

a distance in the axial direction between the first edge portion and the second edge portion of the stem is shorter than a length of the second side portion of the first blade, and is longer than a distance in the axial direction between the first edge portion of the stem and the first wall portion of the casing, formed with the suction port therein;

each of the second blades including:

a first side portion extending along the second side surface of the annular blade mounting member;

a second side portion facing the third wall portion of the casing and extending from the one end toward the second wall portion;

a third side portion located radially more inwardly than the second side portion and extending toward the second wall portion;

a fourth side portion facing the second wall portion of the casing;

the plurality of second blades are disposed radially outside positions at which the other ends of the stems are terminated;

the one end of each second blade is fixed to the second surface of the annular blade mounting member at a position radially outside a position at which the other end of the corresponding stem is fixed; and a distance in the axial direction between the first edge portion and the second edge portion of the stem is shorter than a length of the second side portion of the second blade, and is longer than a distance in the axial direction between the first edge portion of the stem and the first wall portion of the casing, formed with the suction port therein.

* * * * *